US005501167A

United States Patent [19]

Kaye

[11] Patent Number: 5,501,167

[45] Date of Patent: Mar. 26, 1996

[54] SEAT FOR COLLAPSIBLE BOAT

[76] Inventor: Alex R. Kaye, 88 Shearer Dr., Atherton, Calif. 94027

[21] Appl. No.: 410,460

[22] Filed: Mar. 24, 1995

[51] Int. Cl.[6] ..... B63B 17/00

[52] U.S. Cl. ..... 114/363

[58] Field of Search ..... 114/352–354, 363

[56] References Cited

U.S. PATENT DOCUMENTS

| | | | |
|---|---|---|---|
| 3,648,309 | 3/1972 | Novakovich | 114/354 |
| 4,706,597 | 11/1987 | Figone | 114/354 |
| 5,372,085 | 12/1994 | Kaye | 114/352 |

*Primary Examiner*—Jesús D. Sotelo

*Attorney, Agent, or Firm*—Townsend and Townsend and Crew

[57] ABSTRACT

A seat board having a center wing and two side wings. The side wings have lower ends which frictionally engage the surfaces which form the junction between each of a pair of bottom panels and the corresponding pair of side panels. The wings are under compression by the seat board because the ends of the seat board are pinned to the inner surfaces of the adjacent side panels near the top edges thereof. The pins are removable and hold the seat board in place. The side wings operate to prevent or substantially eliminate wobbling of the boat. The side and center wings are pivotally coupled by living hinges to the bottom surface of the seat board.

14 Claims, 1 Drawing Sheet

SEAT FOR COLLAPSIBLE BOAT

This invention relates to collapsible boats and, more particularly, to a board-like seat for such a boat.

BACKGROUND OF THE INVENTION

In U.S. Pat. No. 5,372,085, a collapsible boat is disclosed. The boat has a pair of side panels which are pivotally mounted to respective bottom panels. This arrangement allows the four panels to move from collapsed, generally parallel positions to expanded positions in which the side panels are held apart from each other. This is necessary since the inherent resilience of the material of the boat will tend to collapse the boat.

To keep the side panels of the boat apart, at least a pair of spaced seat boards are placed in expanding relationship to the side panels of the boat. Then, seat boards frictionally engage the inner surfaces of the side panels near the upper edges of the side panels. These seat boards keep the boat expanded until ready to be collapsed, whereupon the boards are taken away from the boat and the side panels assume parallel collapsed positions with the bottom panels. This allows a boat to be readily carried from place to place in a collapsed condition, the collapsing being assisted by the inherent resilience of the material of the boat, such material being a yieldable plastic material which is resistant to damage due to collisions with docks, rocks and the like.

A center wing has been used in the past to support each seat board from beneath. The seat board has a lower end which is placed at the junction of the two bottom panels. This feature centers the seat board and allows it to be sat upon by an occupant of the boat. A disadvantage in using the seat board of the type described above is the wobbling of the boat or the lack of stability of the boat. These problems cannot be experienced for too long of a time before the occupants of the boat feel discomfort due to the unnatural wobbling of the boat. A need exists therefor for some means to inhibit or substantially eliminate the wobbling and the present invention satisfies this need.

SUMMARY OF THE INVENTION

The present invention is directed to an improved seat board having a center wing and two outboard or side wings. The center wing is used in the manner described above and the side wings are inclined when in use. The center wings have lower ends which frictionally engage the edges which form the junction between each bottom panel and the corresponding side panels. The wings are under compression by the seat board because the ends of the seat board are pinned to the inner surfaces of the adjacent side panels near the top edge thereof. The pins for connecting the sides of the seat board are removable and they hold the seat board in place.

The side wings operate to prevent or substantially eliminate wobbling of the boat. The side wings, in cooperation with the center wing, effectively stabilize the boat to thereby improve the movement of the boat over the water. The side and center wings are pivotally coupled by living hinges to the bottom surface of a seat board. Thus, when it is desired to store or retract the collapsible from its expanded condition, the seat board is removed from the boat by widening the boat by pushing the side panels further apart, whereupon the seat board can be removed from frictional engagement with the inner surface of the side panels and the seat board can be pulled out of the boat, whereupon the boat will collapse due to the inherent resilience of the material of the bottom and side panels.

DETAILED DESCRIPTION OF THE PREFERRED EMBODIMENT

Figure 1:
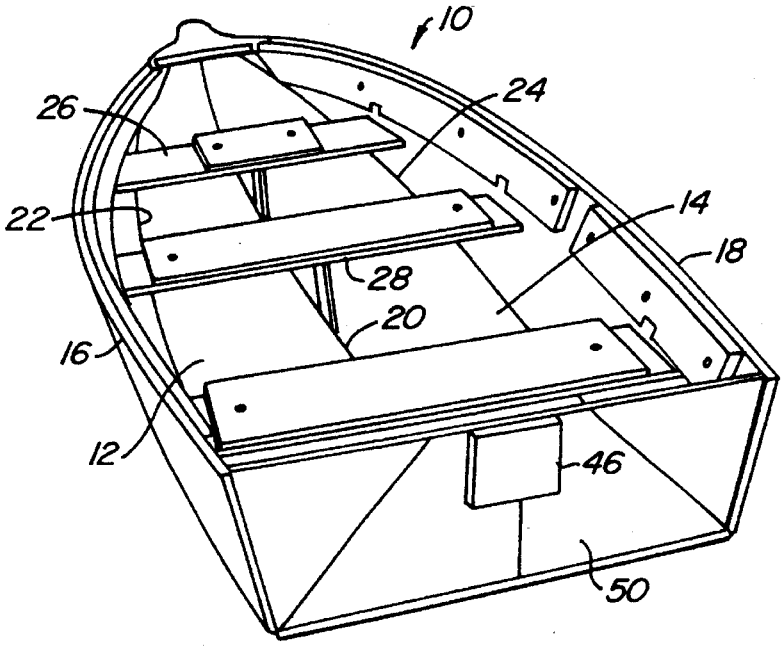
FIG. 1 is a perspective view of a collapsible boat of the type to which the present application is coupled, the boat being shown in its expanded, operative condition.
Figure 3:
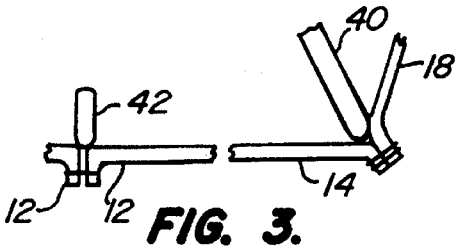
FIG. 3 is a fragmentary rear elevational view of a center wing and a side wing on one of the seats of the boat, showing the way in which the lower ends of the seat wings fit into cracks formed by the pivot means of the bottom panels of the boat.

FIG. 1 illustrates a collapsible boat of the type having a pair of bottom panels 12 and 14 and a pair of side panel 16 and 18. Bottom panels 12 and 14 are coupled along a hinge line 20 and are coupled together by hinge means 22 (FIG. 3). The side and bottom panels are formed from a heavy duty plastic which is yieldable.

Side panels 16 and 18 are hingedly coupled to respective bottom panels along hinge lines 23 and 24 (FIG. 1). Thus, the boat, when collapsed, has the side panel 16 overlying bottom panel 12 and side panel 18 overlying bottom panel 14. The bottom panels 12 and 14, in turn, overlie each other so that both bottom and side panels are, when collapsed, generally parallel with each other for easy carrying of the boat.

Figure 4:
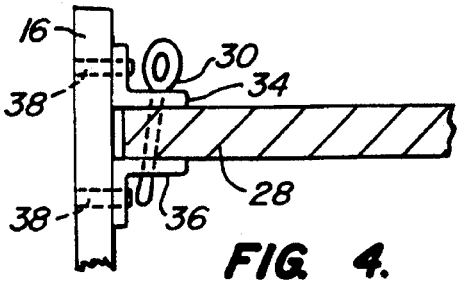
FIG. 4 is an enlarged, fragmentary cross sectional view of the end of the seat board, showing the way in which the seat is coupled to the side of the boat at one end of the seat.

To open or expand the boat, the side panels 16 and 18 are moved apart and away from respective bottom panels 12 and 14. When the side panels 16 and 18 are sufficiently far apart, a pair of board seats 26 and 28 are put into place in bridging relationship to the side panels as shown in FIG. 1. When so positioned, the ends of the seats 26 and 28 bear against the inner surfaces of respective side panels 16 and 18. In the alternative, the ends of the seat boards can be pinned as shown in FIG. 4 so that the ends of the seat are fixed and releasably held to the respective side panels of the boat by a pin 30 which passes through the end of the seat board, for instance, seat board 28, and through flanges 34 and 36 carried by fasteners 38 on the side wall 16, for instance, of the boat. The pins are removably separated by pulling upwardly on the pin upper ring. Also, to insert the pins, they are placed in the holes of seat 28 and flanges 34 and 36 quickly and easily.

Each of the seat boards 26 and 28 has a pair of side wings 40 and a center wing 42. Each of the wings 40 and 42 is provided with a living hinge of plastic or other suitable material, the hinge being denoted by the numeral 44 and being secured to the underside of the respective seat 26 or 28 by a fastener.

The side wings 40 are adapted to be swung downwardly when the seat board is in place in the boat and the lower end of each seat board wing is adapted to move into frictional engagement with the bottom and side panels adjacent thereto as shown in FIG. 3. The frictional engagement lodges the lower end edge of each of the wings 40 in the crack or junction between the bottom and side panels adjacent thereto. The material of the boat being of a heavy duty plastic, can be and is yieldable to seat the lower end of the side wing 40 sufficiently tightly so that there is a snug, frictional fit between the wing 40 and the crack or junction between the adjacent bottom and side panels. This rigidifies the connection between the seat and the bottom and side panels and makes a tight fit so that there is no vibration of the seat such as when a motor is on the rear end of the boat on the panel 46 thereof.

The center wing 42 has essentially the same construction as each of the wings 40. The lower end of the wing 42 is rounded and fits into the crack at the junctions between bottom panels 12 and 14 as shown in FIG. 3. When the lower end of the wing 42 is in frictional engagement with the adjacent surfaces of bottom panels 12, the seat is rigidified and does not vibrate such as when a motor is attached to the rear of the boat on mounting pad 46 (FIG. 1).

With the boat expanded, a motor can be placed on the pad 46. The pad will be adjacent to a transom 50 forming part of the collapsible boat and this transom can be flexible if desired so that it can be a permanent part of the boat and can be folded into place without removing the transom from connection with the bottom or side panels of the boat. If the transom is collapsible, it can be collapsed along lines 52. In the alternative, the transom can be stiff, removable and coupled with a seal means for sealing the junction between the transom and the boat panels.

Figure 2:
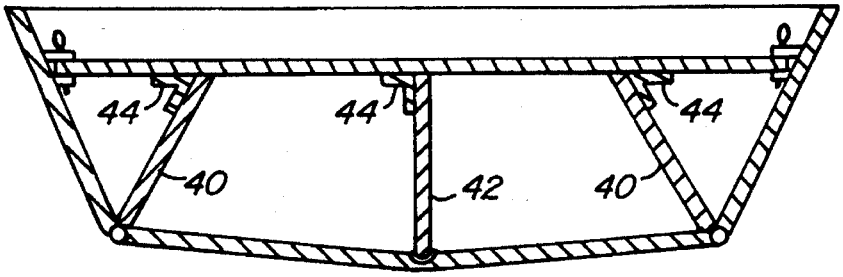
FIG. 2 is a vertical section through the boat in its expanded condition, showing the way in which the side wings on one seat board of the boat are placed in operative condition.
Figure 5:
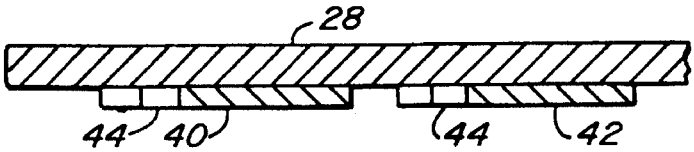
FIG. 5 is a cross sectional view showing the way in which the hinges allow the seat wings to be pivoted into positions underlying the bottom surface of the seat.
Figure 6:
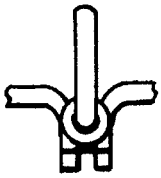
FIG. 6 is a view similar to FIG. 3 but showing a ring at the lower end of the center wing of the seat to illustrate a further embodiment of the trapping of the wing in the lower center crack of the bottom formed by the two bottom panels of the boat.

When it is desired to collapse the boat, the pins 30 are removed (FIG. 4) and the boat seats are lifted from the positions shown in FIG. 2. This may require that the side panels 16 and 18 be further separated slightly to avoid the frictional contact with the ends of the seats. As soon as the seats 26 and 28 are lifted from the boat, the wings 40 and 42 can be pivoted into a position parallel with the respective seats as shown in FIG. 5. Then, the rest of the boat can be collapsed and the seats can be tied together with a rope to the rest of the boat with the panels 26 and 28 and are parallel with the side and bottom panels.

The main advantage of using the side panels and the side wings is to keep the boat from wobbling as it moves forwardly either by being paddled or under the influence of a motor. The wings, with center wing 42 also stabilize the boat and render it seaworthy notwithstanding several people in the boat itself.

I claim:

1. In a collapsible boat having a pair of pivotally coupled bottom panels at a first junction and a pair of side panels pivotally coupled at second junctions, the side panels being pivotally coupled to the outer edges of respective bottom panels, a seat board assembly comprising:

a seat board for placement between said side panels;

a center wing secured to the seat board near the center part thereof, said center wing adapted to extend downwardly from the seat board and adapted to frictionally engage said first junction;

a pair of side wings extending downwardly and away from the seat board with the side wings being inclined, the lower ends of the side wings being adapted to frictionally engage the second junctions; and means for coupling the ends of the board to the side panels.

2. In a collapsible boat as set forth in claim 1, wherein said center and side wings are shiftably mounted on the seat board.

3. In a collapsible boat as set forth in claim 1, wherein said wings are pivotally mounted on the bottom surface of the seat board.

4. In a collapsible boat as set forth in claim 1, wherein the wings are made of wood.

5. In a collapsible boat as set forth in claim 1, wherein the wings are inclined when they extend between the seat board and the second junctions.

6. In a collapsible boat as set forth in claim 1, wherein each wing has a living hinge, the living hinge being secured to the bottom surface of the seat board and coupled with respective wings.

7. In a collapsible boat as set forth in claim 1, wherein the means coupling the ends of the seat board includes pins removably coupled to the side walls and the seat board.

8. In a collapsible boat:

a pair of pivotally coupled bottom panels at a first junction and a pair of side panels for pivotally coupling at second junctions to the outer edges of respective bottom panels; and a seat board assembly including a seat board for placement between said side panels when the side panels are in expanded positions, a center wing secured to the seat board near the center part thereof, said center wing extending downwardly from the seat board and to frictionally engaging said first junction, a pair of side wings extending downwardly and away from the seat board with the side wings being inclined, the lower ends of the side wings frictionally engaging respective second junctions, and means for coupling the ends of the seat board to the side panels.

9. In a collapsible boat as set forth in claim 8, wherein said center and side wings are shiftably mounted on the seat board.

10. In a collapsible boat as set forth in claim 8, wherein said wings are pivotally mounted on the bottom surface of the seat board.

11. In a collapsible boat as set forth in claim 8, wherein the wings are made of wood.

12. In a collapsible boat as set forth in claim 8, wherein the wings are inclined when they extend between the seat board and the second junctions.

13. In a collapsible boat as set forth in claim 8, wherein each wing has a living hinge, each living hinge being secured to the bottom surface of the seat board and coupled with respective wings.

14. In a collapsible boat as set forth in claim 8, wherein the means coupling the ends of the seat board includes pins removably coupled to the side panels and the seat board.

* * * * *